US008056612B2

(12) United States Patent
Kapaj et al.

(10) Patent No.: US 8,056,612 B2
(45) Date of Patent: Nov. 15, 2011

(54) DELIVERY DEVICE AND METHOD FOR USING THE SAME

(75) Inventors: Nuredin Kapaj, Udine (IT); Alfredo Poloni, Fogliano Redipuglia (IT); Fabio Vecchiet, Cervignano Del Friuli (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 190 days.

(21) Appl. No.: 12/158,228

(22) PCT Filed: Dec. 20, 2006

(86) PCT No.: PCT/EP2006/069968

§ 371 (c)(1),
(2), (4) Date: Jun. 19, 2008

(87) PCT Pub. No.: WO2007/071704

PCT Pub. Date: Jun. 28, 2007

(65) Prior Publication Data

US 2008/0257524 A1 Oct. 23, 2008

(30) Foreign Application Priority Data

Dec. 23, 2005 (IT) ..... MI2005A2470

(51) Int. Cl.
*B22D 11/06* (2006.01)
*B22D 11/10* (2006.01)
*B22D 41/50* (2006.01)

(52) U.S. Cl. ..... 164/480; 164/428; 164/437; 164/488; 222/606

(58) Field of Classification Search ..... 164/480, 164/428, 437, 488; 222/606
See application file for complete search history.

(56) References Cited

U.S. PATENT DOCUMENTS

| | | | | |
|---|---|---|---|---|
| 6,070,647 | A * | 6/2000 | Folder et al. | 164/480 |
| 6,095,233 | A | 8/2000 | Leabeater et al. | |
| 6,889,749 | B2 * | 5/2005 | Poloni et al. | 164/428 |

FOREIGN PATENT DOCUMENTS

| | | |
|---|---|---|
| EP | 0850712 | 7/1998 |
| WO | 97/27015 | 7/1997 |
| WO | 2004065039 | 8/2004 |

OTHER PUBLICATIONS

Written Opinion of the International Searching Authority, PCT/EP2006/069968.

* cited by examiner

*Primary Examiner* — Kevin P Kerns
(74) *Attorney, Agent, or Firm* — Reising Ethington P.C.

(57) ABSTRACT

A discharge device discharges liquid steel into a roller crystallizer for the continuous casting of thin strip. The discharge device reduces turbulence at the meniscus to a minimum so as to eliminate the relative defects on the cast strip by passing the steel between two crystallizer rollers. A relative casting process provides expedients for improving the steel feeding from a tundish to the crystallizer. Advantageously, the feeding of guided steel jet streams inside the nozzle, or delivery nozzle, eliminates the disturbance at the meniscus caused by the air bubbles which can form when free-falling jet streams come into contact with the air.

8 Claims, 5 Drawing Sheets

DELIVERY DEVICE AND METHOD FOR USING THE SAME

FIELD OF THE INVENTION

The present invention refers to a delivery device and the relative process for casting liquid steel in a twin-roller crystallizer in continuous strip casting.

PRIOR ART

In strip casting by means of twin-roller crystallizers the liquid steel is distributed between the two rollers by means of a delivery device or nozzle and in a very short time, approximately some fraction of a second, it starts to solidify forming two solid skins that, joining together between the two rollers, form the thin strip.

Only a very small amount of steel is contained between the two rollers of the crystallizer, which means that any disturbance in said steel feeding, from the tundish to the crystallizer, is immediately felt at the meniscus creating a turbulence and thus causing problems during the initial phase of solidification, resulting in the formation of defects on the cast strip.

The prior art discloses several types of devices for delivering liquid steel in continuous strip casting by means of a twin-roller crystallizer.

The delivery device described in document U.S. Pat. No. 6,070,647 attempted to improve the flow feeding the liquid steel to the crystallizer.

In order to reduce disturbance of the steel between the rollers, said delivery device, which is partially immersed in the casting pool, is fed through a plurality of holes arranged on the bottom of the tundish. This plurality of holes produces a plurality of free-falling jet streams distributed along the extension of the delivery device. In this manner there is less disturbance at the meniscus region than that one obtained with a single jet stream feeding.

At its turn, the nozzle distributes the liquid steel in the casting pool, contained between the two rollers, through a series of openings arranged along the length of the rollers, said openings being slightly immersed beneath the meniscus.

Disadvantageously, however, the free-falling jet streams from the tundish to the inside of the nozzle cause air to be drawn into the liquid steel creating bubbles that then flow into the casting pool. As they rise, the bubbles explode and generate turbulence at the meniscus region in the form of fluctuations which result in the formation of defects on the surface of the cast strip as the skin is not able to form properly on the rollers; these defects make the product unmarketable.

The need is therefore felt to produce a new delivery device and a casting process capable of overcoming the drawbacks described above.

SUMMARY OF THE INVENTION

A first purpose of the present invention is to produce a delivery device capable of containing within minimum values the turbulence at the meniscus so that the latter is substantially flat and of preventing the formation of defects on the cast strip by passing the liquid steel between the two crystallizer rollers.

Another purpose is to implement a casting process that provides for particular expedients for improving the steel feeding from the tundish to the crystallizer.

The present invention, therefore, proposes to achieve the objectives described above by providing a delivery device for delivering liquid steel into a crystallizer with two rollers. The invention includes a first vessel suitable for containing liquid steel. A plurality of substantially vertical and aligned ducts provided on the bottom of the vessel are suitable for generating discharge jet streams of the liquid steel. A second longitudinal vessel with an upper part open, suitable for receiving in its inside the jet streams, and comprising side walls and a bottom. The second longitudinal vessel receives the vertical ducts whereby the discharge jet streams are guided inside the second vessel. Each of the side walls is provided with a longitudinal slot, having a length equal to the length of the crystallizer rollers, suitable for generating a constant and non-turbulent flow in a casting pool comprised between the two rollers.

Said purposes are also achieved with a process for casting liquid steel in a crystallizer with two rollers for producing steel strip, that uses the delivery device described above, said process comprising the following steps:

production of discharge jet streams of the liquid steel from a first vessel into a second longitudinal vessel with the upper part open, said jet streams being guided by a plurality of vertical and aligned ducts that extend into said second longitudinal vessel, generation of a constant and non-turbulent flow of said liquid steel, from said second vessel towards a casting pool comprised between the two rollers, through a longitudinal slot provided on each of the side walls of the second vessel, so as to obtain a substantially flat meniscus region in said casting pool.

Advantageously the feeding of guided steel jet streams inside the delivery device eliminates the disturbance at the meniscus region deriving from the air bubbles that form when the free-falling jet streams come into contact with the air, as occurs in the known devices and plants. Furthermore the presence of a single large slot in proximity to the bottom of the delivery nozzle, which is completely immersed beneath the meniscus of the casting pool, guarantees an uniform and almost laminar flow entering said casting pool, having a substantially V shape. This solution eliminates the turbulence at the meniscus region in the area of initial solidification and eliminates the possibility of forming defects on the surface of the strip, cast between the two rollers, due to the same turbulence. The dependent claims describe preferred embodiments of the invention.

BRIEF DESCRIPTION OF THE DRAWINGS

Further characteristics and advantages of the invention will become clear from the following detailed description of a preferred, but not exclusive, embodiment of a delivery device, that is merely illustrative and not limitative, with the help of the drawings attached hereto, in which.

DETAILED DESCRIPTION OF A PREFERRED EMBODIMENT OF THE INVENTION

With reference to the drawings, a delivery device for producing a thin strip is represented, comprising:

a ladle (not illustrated), a tundish 3, a delivery nozzle 1, a crystallizer 2 with two rollers 4.

The liquid steel is supplied by the ladle to the tundish 3. Advantageously there may be provided an under-tundish 3', which is much smaller than the tundish. The tundish 3 and under-tundish 3' are both made of a refractory material and their cascade arrangement advantageously permits to reduce the kinetic energy of the liquid steel entering the crystallizer 2, and thus also permits to limit meniscus disturbance. Since the level or head of the steel in the under-tundish 3' is very low with respect to the level in the tundish 3, the disturbance of the steel in the casting pool between the rollers 4 is greatly reduced because the feeding kinetic energy is reduced.

Figure 4C:
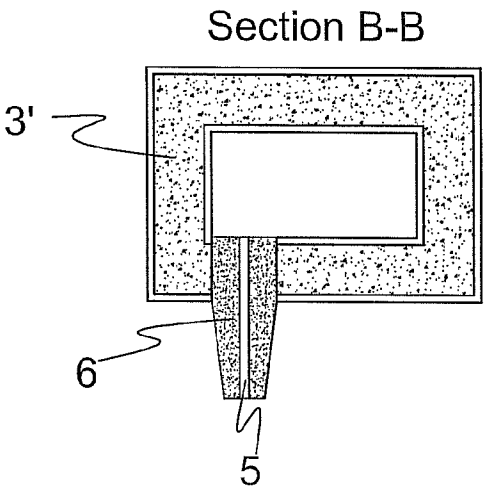
FIG. 4*c* shows a cross-section along the line B-B of the second component in FIG. 4*a;*
Figure 4B:
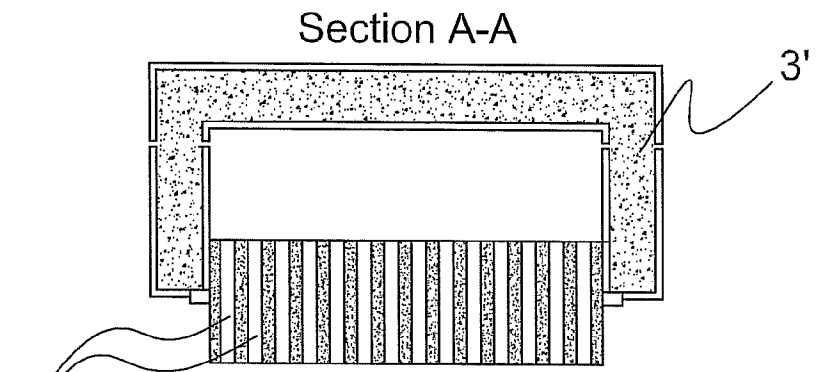
FIG. 4*b* shows a cross-section along the line A-A of the second component in FIG. 4*a;*
Figure 4A:
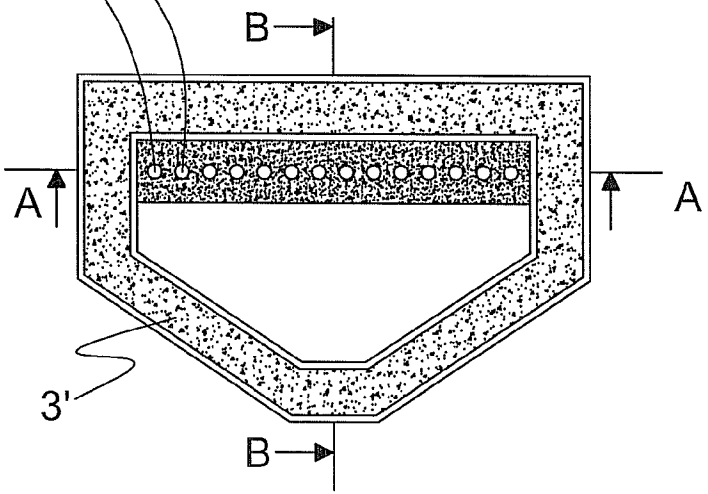
FIG. 4*a* shows a section of a plan view of a second component of the device according to the invention.

In order to reduce further the disturbance of the steel between the two crystallizer rollers 4, the steel is delivered from the under-tundish 3' through a plurality of substantially vertical calibrated holes or ducts 5, illustrated in FIG. 4. The holes 5 are distributed along the entire length of the under-tundish 3', or possibly of the tundish 3, and are suitable for producing jet streams distributed along the entire length of the rollers. Advantageously, in fact, the delivery nozzle 1 downstream, only partially immersed in the casting pool, has the same longitudinal length as the under-tundish 3'.

A further advantage is represented by the fact that these jet streams are not free-falling but are appropriately guided until inside the same delivery nozzle, arranged between the two rollers. In such a way the meniscus disturbance due to air bubbles is avoided since these latter are no longer generated. In fact, the discharge of the jet streams into the delivery nozzle 1 advantageously occurs beneath the head, that is below the meniscus 21 inside the delivery nozzle.

Figure 1:
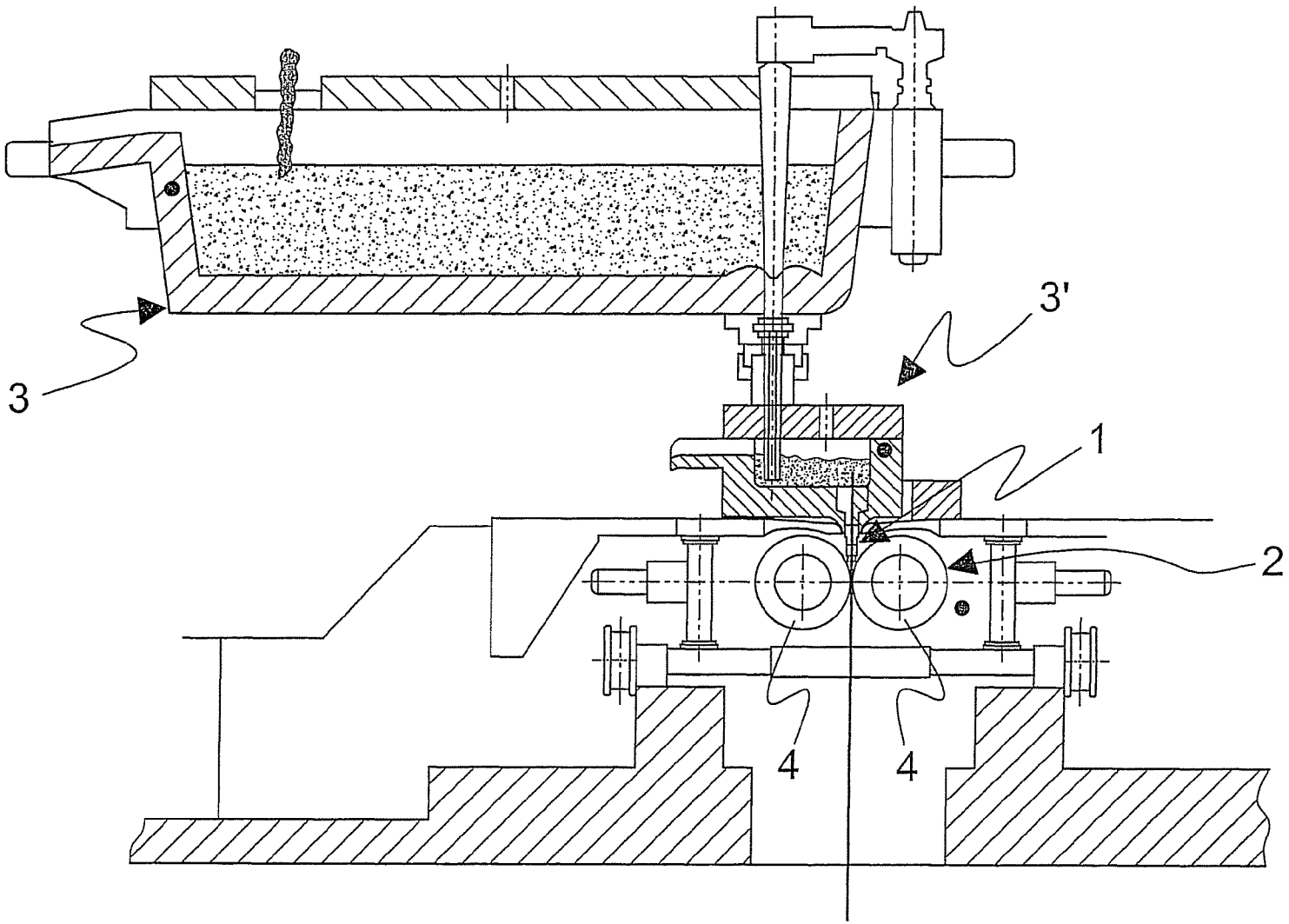
FIG. 1 shows a longitudinal cross-section of the delivery device according to the invention.
Figure 2B:
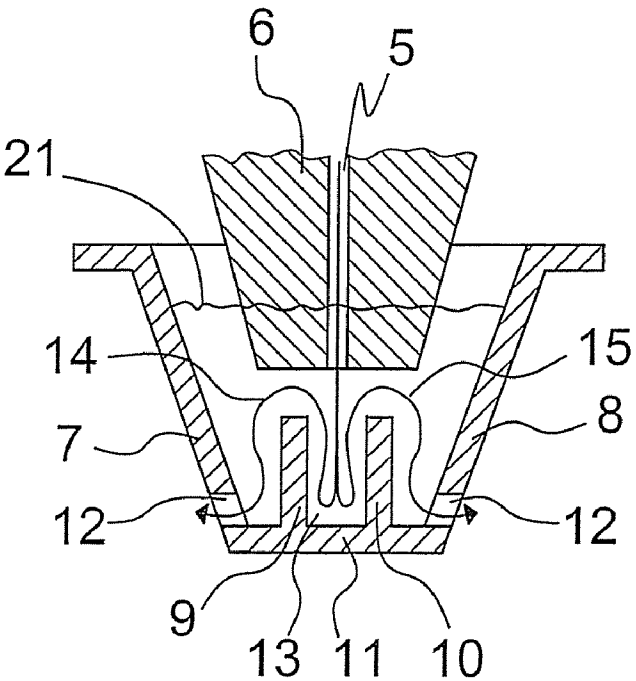
FIG. 2*b* shows a cross-sectional view of a component of the delivery device according to the invention.
Figure 2A:
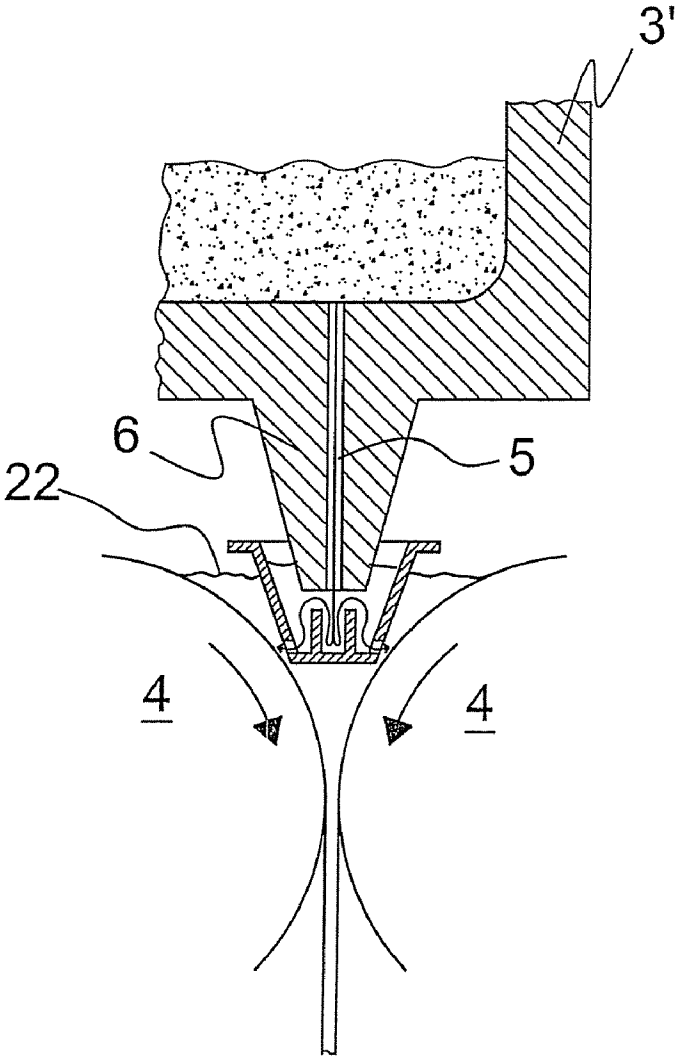
FIG. 2*a* shows an enlarged cross-sectional view of some components of the device in FIG. 1.
Figure 3B:
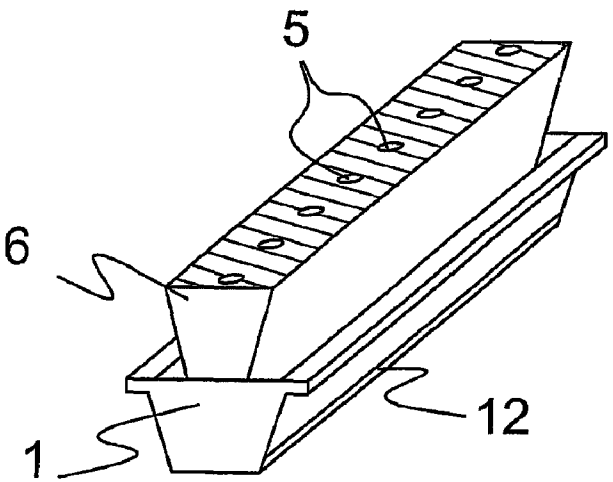
FIGS. 3*a* and 3*b* show perspective views respectively of a portion of the device in FIG. 1 and of a component of said portion of the device.
Figure 3A:
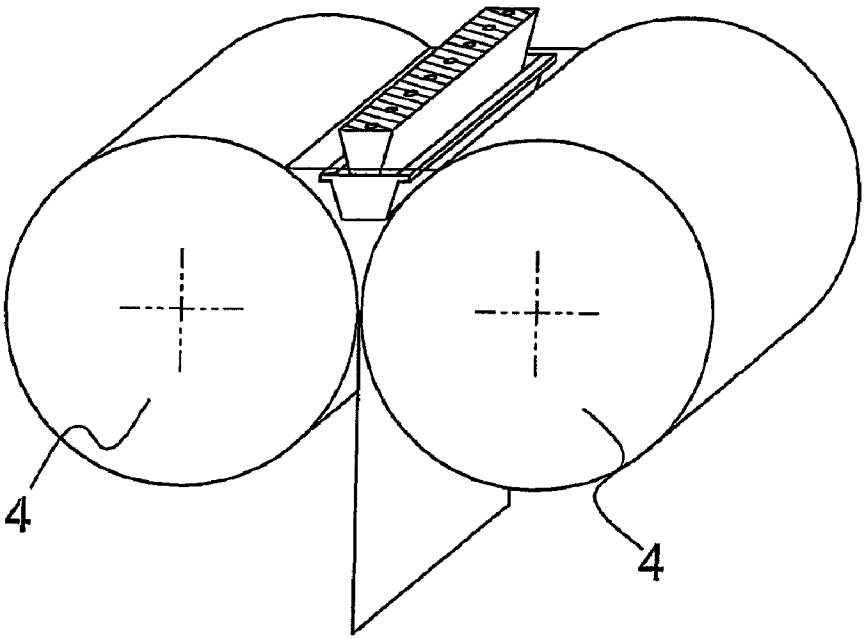

FIG. 2*a* illustrates a portion of a cross-section of the under-tundish 3' the bottom of which is provided with a protuberance 6 made of refractory material, either machined or appropriately housed on the bottom of said under-tundish, in which the calibrated holes or ducts 5 are produced. Said protuberance 6 preferably has a tapered shape so that it can easily be inserted inside the delivery nozzle 1 below. This does not exclude the fact that said protuberance may also have different shapes, for example that one of a parallelepiped.

The delivery nozzle 1 has the advantageous configuration illustrated in FIG. 2*b*. It is provided with two side walls 7, 8, preferably but not necessarily sloping, and a bottom 11. Advantageously the delivery nozzle 1 comprises two intermediate flow breaker walls 9, 10, preferably of between 10 and 50 mm in height, that reduce the turbulence of the jet streams flowing out from the calibrated holes 5 and, thus, the turbulence inside the delivery nozzle.

Advantageously the bottom end of the protuberance 6 or of the holes or ducts 5 is placed at a distance of between just 5 and 40 mm from the upper ends of the flow breaker walls 9, 10, so that there is only a slight turbulence at the meniscus 21 inside the delivery nozzle.

The guided jet streams pass through the holes 5 into the space or central inner chamber 13 of the delivery nozzle 1; when the chamber 13 is full the flow follows the path shown by the arrows 14 and 15 in FIG. 2*b* and, after flowing over the flow breaker walls 9, 10, enters the casting pool, below the meniscus 22, through a longitudinal slot 12 provided in proximity to the corners formed by the side walls 7, 8 with the bottom 11 and extending for the entire longitudinal length of the delivery nozzle.

The liquid steel flow entering the casting pool enclosed between the two crystallizer rollers 4 is a substantially laminar flow, constant and non-turbulent, and this guarantees a substantially flat profile of the meniscus 22 during casting.

Figure 5:
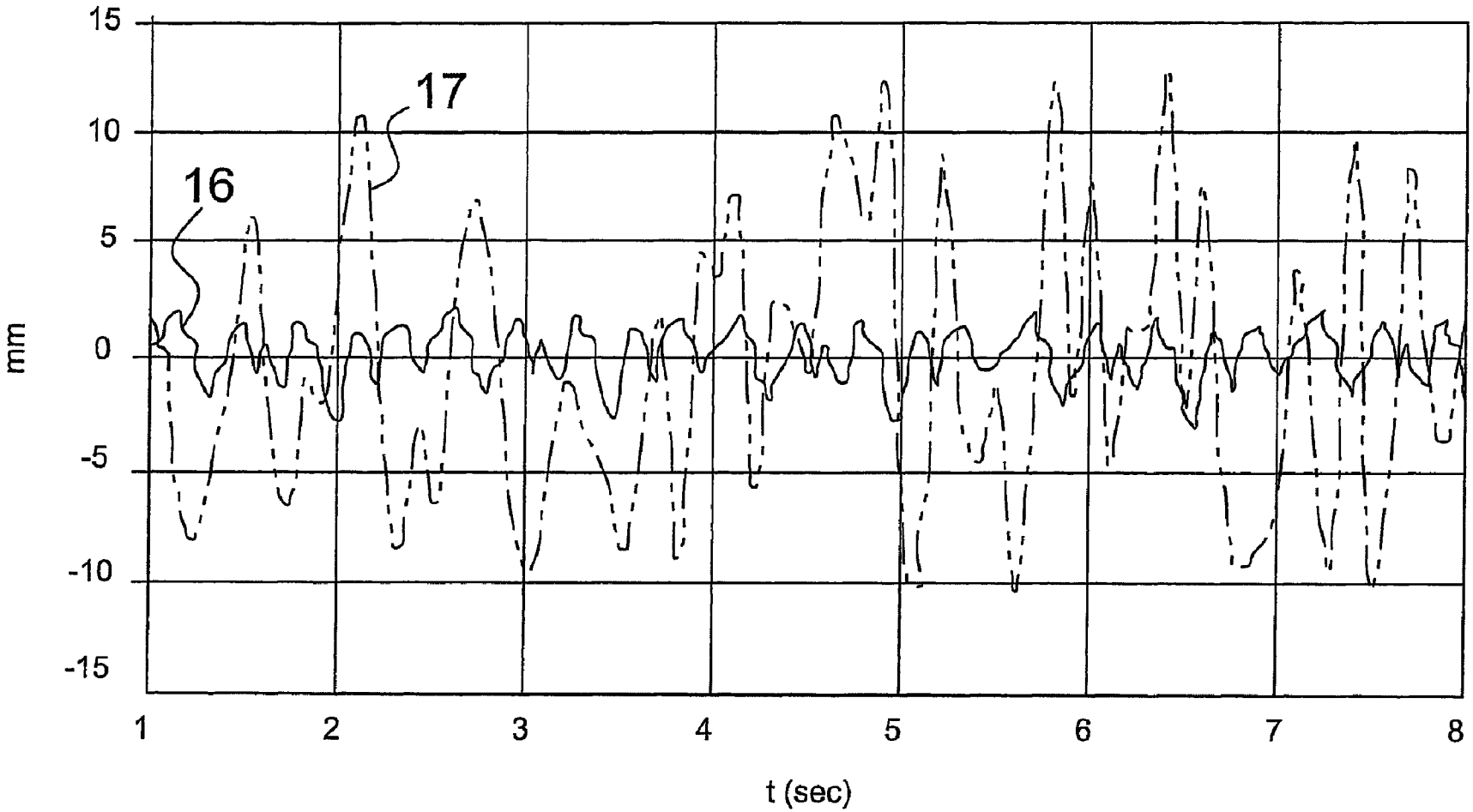
FIG. 5 shows the time pattern of meniscus fluctuations in two different methods of liquid steel feeding.

The diagram in FIG. 5 shows the trend on time of the fluctuations at the meniscus 22 in the casting pool, with amplitude expressed in mm. The curve 16 illustrates said trend when using the delivery nozzle according to the present invention; the curve 17 illustrates the trend of meniscus fluctuations when using prior art delivery devices. It can be observed that with the delivery device according to the invention the amplitude of said fluctuations is advantageously less than 3 mm with respect to a completely flat meniscus.

Lastly, as the steel then passes between the rollers 4, the solidifying areas of skin join to obtain a cast strip of a predefined thickness and with no surface defects.

The specific embodiments here described are not limitative and this patent application covers all the alternative embodiments of the invention as set forth in the claims.

The invention claimed is:

1. Discharge device for discharging liquid steel into a crystallizer with two rollers each defining a roller length, said discharge device comprising:

a first vessel suitable for containing liquid steel, a plurality of substantially vertical and aligned ducts provided on the bottom of said first vessel and suitable for generating discharge jet streams of the liquid steel, a second longitudinal vessel defining a vessel length equal to the roller length, said second longitudinal vessel including an upper part open, suitable for receiving in its inside said jet streams, and comprising side walls and a bottom, wherein said vertical ducts extend inside the second longitudinal vessel whereby said discharge jet streams are guided inside said second vessel, and in that each of said side walls is provided with a single longitudinal slot, having a slot length equal to said vessel length, suitable for generating a constant and non-turbulent flow into a casting pool comprised between the two rollers.

2. Device according to claim 1, wherein said vertical ducts are arranged in a protuberance that is an integral part of the first vessel or is housed therein.

3. Device according to claim 2, wherein said second vessel comprises an inner chamber delimited by intermediate walls.

4. Device according to claim 3, wherein the lower ends of the vertical ducts are at a distance of between 5 and 40 mm from the upper ends of the intermediate walls.

5. Device according to claim 4, wherein said intermediate walls are preferably between 10 and 50 mm in height.

6. Device according to claim 1, wherein the first vessel is a tundish.

7. Device according to claim 1, wherein the first vessel is an under-tundish.

8. A process for casting liquid steel in a crystallizer with two rollers to produce steel strip using a discharge device having a first vessel defining a plurality of vertical and aligned ducts and a second longitudinal vessel with an open upper part for receiving the plurality of vertical and aligned ducts therein and a floor with sidewalls extending upwardly therefrom, the process comprising the following steps:

providing the discharge device of claim 1;

discharging the liquid steel from a first vessel through the plurality of vertical and aligned ducts into a second longitudinal vessel near the floor thereof; and releasing the liquid steel in a constant and non-turbulent flow from the second vessel towards a casting pool comprised between the two rollers, through a single longitudinal slot provided on each of the side walls of the second vessel, so as to obtain a substantially flat meniscus in the casting pool.

* * * * *